United States Patent [19]

Estévez

[11] Patent Number: 4,484,062

[45] Date of Patent: Nov. 20, 1984

[54] HEATER STRUCTURE

[76] Inventor: Orestes Estévez, 7801 SW. 22nd St., Miami, Fla. 33155

[21] Appl. No.: 401,094

[22] Filed: Jul. 23, 1982

[51] Int. Cl.[3] ..... H05B 1/02; F24H 1/10; H01H 35/40

[52] U.S. Cl. ..... 219/309; 137/341; 200/81.9 R; 219/307; 219/332; 219/496

[58] Field of Search ..... 219/296, 306–309, 219/332, 496; 137/341; 200/81.9 R

[56] References Cited

U.S. PATENT DOCUMENTS

| | | | |
|---|---|---|---|
| 1,357,287 | 11/1920 | Hart | 219/308 |
| 1,437,046 | 11/1922 | Dominguez | 219/309 X |
| 1,505,828 | 8/1924 | Walberg | 219/309 |
| 2,720,581 | 10/1955 | Lorenzetti | 219/309 |
| 3,560,706 | 2/1971 | Fonseca | 219/309 |

FOREIGN PATENT DOCUMENTS

| | | | |
|---|---|---|---|
| 577340 | 5/1958 | Italy | 219/307 |
| 581617 | 9/1958 | Italy | 219/307 |
| 605195 | 5/1960 | Italy | 219/309 |

*Primary Examiner*—A. Bartis

*Attorney, Agent, or Firm*—John Cyril Malloy

[57] ABSTRACT

An electric heater structure designed to be used as an auxiliary water heater for showers, sinks and the like includes a housing defining a water heating chamber having an inlet for connection to a water supply pipe and an outlet for discharging heated water through an attached sprayhead. A pair of electric resistance heating coils of different length and thus different heat output are positioned within the chamber for heating the water. A selector switch manually operated by a lever is provided in a switch casing mounted on the housing and is arranged to energize one or the other of the heating coils to produce either hot or warm water. A set of diaphragm actuated contact elements cooperate with the selector switch to allow energization of the heating coils only if water is flowing through the chamber from the inlet to the outlet thereof.

1 Claim, 9 Drawing Figures

FIG. 1
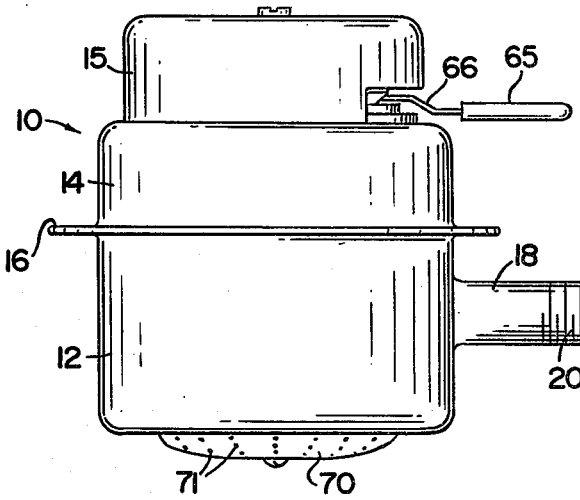
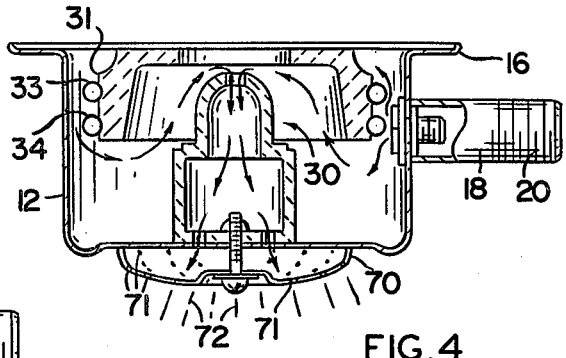
FIG. 4
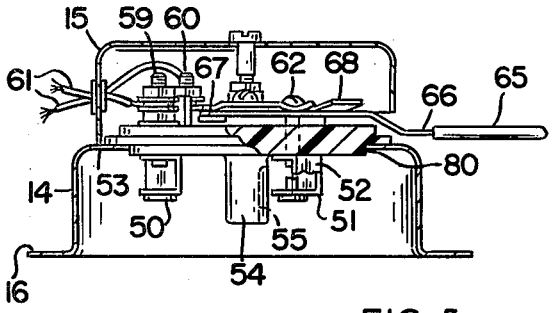
FIG. 5
FIG. 2
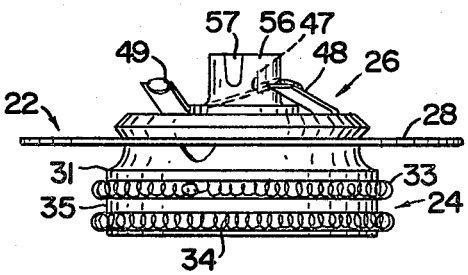
FIG. 3
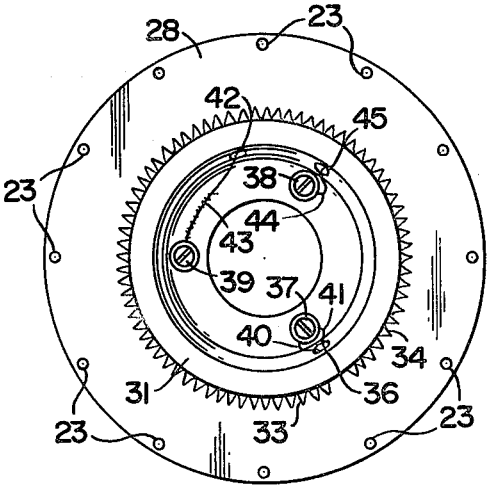
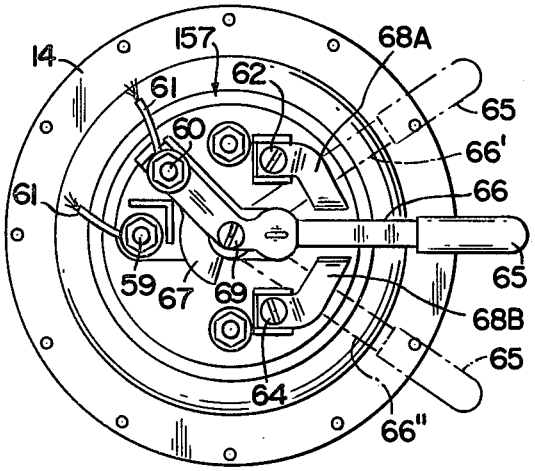
FIG. 6

HEATER STRUCTURE

BACKGROUND OF THE INVENTION

1. Field of the Invention

This invention is directed to a heater structure designed to heat water issuing from a typical water supply in a manner to reduce the amount of energy normally consumed in heating water through the use of conventional domestic water tanks or the like. The structure is attachable diectly to the aater outlet rather than encompassing heat storage type capacity as in conventional systems.

2. Description of the Prior Art

It is well known that large amounts of elctricity are utilized in the home for the heating of water. In fact, it has been estimated that between 30 and 40 percent of the average electric bill of a residence may be attributed to the use of electricity for heating water. Also, it is well recognized that a majority of such heated water is used for showering, body washing, and the like.

With the current recognized shortage of fossil fuels, attempts have been made through a variety of system designs as well as smaller component type structures to reduce the use of energy thereby reducing the dependence on fossil type fuels. There has been an emphasis on solar radiation collectors throughout the industry wherein the solar collectors are used to heat water from the sun's energy and store this water for later use. While the majority of currently available and prior art type systems are operable, they do suffer from certain inherent problems. Such problems include generally high cost of installation as well as low efficiency operating characteristics. Therefore, solar systems are generally limited in their use and application.

Accordingly, there is a need for devices which have a low cost of initial purchase as well as installation and which are capable to reduce the amount of energy needed to provide hot water through a desired and selective temperature range for a variety of uses such as body washing in the average residence. The installation of such a device saves a considerable amount of the average electrical energy bill if such a device was even limited to the use of heating water for showers and the like.

SUMMARY OF THE INVENTION

The present invention is directed toward a water heater device of the type primarily designed to serve as an auxiliary water heater. More particularly, the subject heater structure is attachable to water outlets in the home and may take the place of conventional showerheads or faucets in bathtubs, showers, or sinks.

The subject water heater structure comprises a housing means having a water inlet attached thereto. The water inlet is designed to be attached directly to a water pipe or the like and receive water from a conventional source. The housing means comprises a water chamber which is designed to receive water from the water inlet. A water outlet is attached on the interior of the water chamber and directs water within the chamber out through a sprayhead which may be attached to the exterior portion of the housing means. The sprayhead may include a plurality of dispersion holes or apertures which define the spray pattern of water issuing from the housing means.

The housing means further comprises a contact casing which connects directly to the water chamber but is separated therefrom as will be explained in greater detail hereinafter.

A heating assembly is mounted on the interior of the housing and includes a heating component disposed within the water chamber. The heating component includes one or more heating coils mounted thereon and positioned in direct contact with water flowing throughout the chamber and about the heating component. The heating assembly further comprises a contact assembly attached to the heating component and extending into the contact casing. A flexible material diaphragm is interconnected about its outer periphery to the housing means between the water chamber and the contact casing and is connected about its inner portion to the heating assembly. More particularly, the diaphragm serves to separate the heating component located within the heating chamber and the contact assembly located within the contact casing. The diaphragm further tends to define a watertight seal between the two chambers so as to prevent water from exiting the water chamber other than through the water outlet.

The contact assembly comprises a plurality of contact elements each being electrically attached to one end of the coils serving to at least partially define an electrical circuit which directs electric current to the coils for heating thereof.

A plurality of terminal contacts also disposed within the contact casing and extend outwardly from the base thereof into mating engaging relation with respective ones of the plurality of contact elements. A switch means is mounted within a switch casing and comprises a plurality of terminal elements. The terminal elements are electrically connected directly to a conventional outside source of electric power. Two additional terminal elements serve as connection to the contact terminals as set forth above. A switch lever may be utilized to move between electrical circuit making connections as between the power terminal elements and one of the element terminals connected to the coils. In such position, the respectively positioned coil terminal element serves to complete a circuit between the conventional electrical power source thereby providing current flow to one of the two resistance coils. This coil is thereby heated and this resulting heat is transferred to the surrounding water within the water chamber. In that one of the two coils is considerably longer, more heat is provided to the water within the water chamber than that provided if the shorter resistance coil was heated. Accordingly, the user of the subject structure may selectively regulate the heat between warm and/or hot as desired.

Actual contact or circuit completion takes place due to the fact that the diaphragm is flexed or biased into a contact completing position as water is forced into and almost fills the water chamber. It is readily seen that the switch lever may also be moved to a completely off position thereby breaking all electrical contact and ceasing current flow to either one of the resistance coils attached to the heating component.

The invention accordingly comprises the features of construction, combination of elements and arrangement of parts which will be exemplified in the construction hereinafter set forth, and the scope of the invention will be indicated in the claims.

DESCRIPTION OF THE DRAWINGS

For a further understanding of the nature of the invention, reference should be had with the following detailed description taken in connection with the accompanying drawings, and in which:

FIG. 1 is a front plan view of the heater structure of the present invention with certain internal structure of the heating assembly shown in broken lines.

FIG. 2 is a front plan view of the heating assembly of the present invention.

FIG. 3 is a bottom view of the heating assembly of FIG. 2.

FIG. 4 is a sectional view of the water chamber portion of the housing of the present invention showing interior structural features at relevant positions of the heating components to the water outlet within the heating chamber.

FIG. 5 is a sectional view showing the interior structure of the switching means of the present invention.

FIG. 6 is a top plan view with the switch casing removed showing the interior structural features of the switching assembly of the present invention.

Similar reference characters refer to similar parts throughout the several views of the drawings.

DETAILED DESCRIPTION OF THE PREFERRED EMBODIMENT

Figure 7:
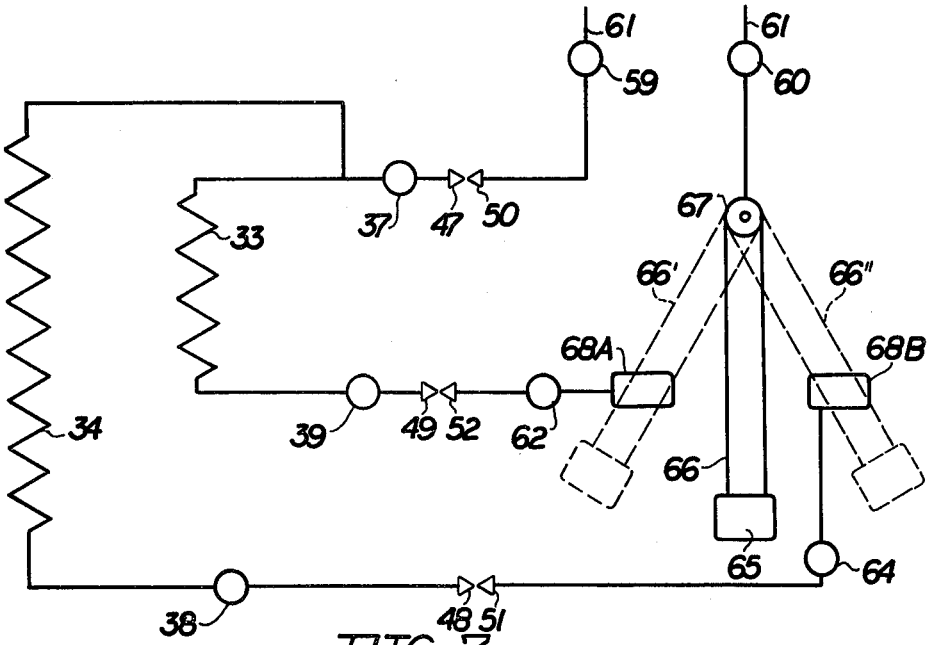
FIG. 7 is a schematic representation of the circuitry involved in the switching assembly of the present invention.
Figure 8:
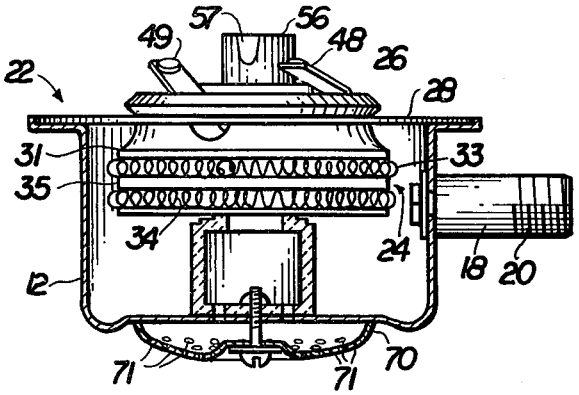
FIG. 8 is a view in partial section of the structures disclosed in FIGS. 2 and 4 in assembled relation.
Figure 9:
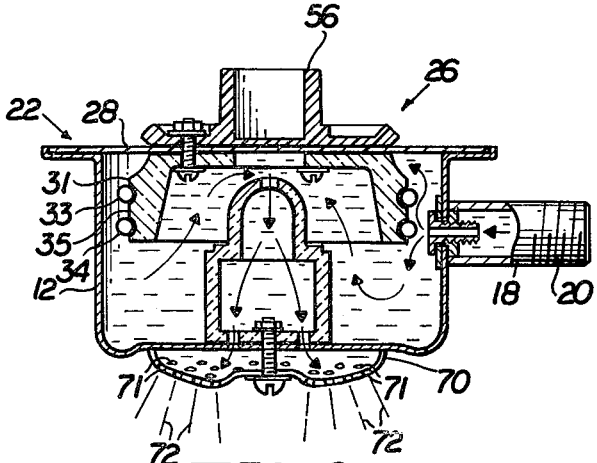
FIG. 9 is a sectional view of the structure shown in FIG. 8.

FIG. 1 shows the heater structure of the present invention comprising a housing means and generally indicated as 10. The housing means includes a water chamber 12 and a contact casing 14 interconnected to one another in substantially stacked array about a common outer periphery generally indicated as 16.

A water inlet generally indicated as 18 is defined by a pipe element having connector means 20 formed about one end thereof for proper interconnection to conventional water piping or water outlets which are part of the residence. As set forth above, the entire structure, by virtue of its configuration may be attached in the place of a conventional showerhead or otherwise attached to a faucet or like in a sink.

With reference to FIG. 2, the subject invention further comprises a heating assembly generally indicated as 22 and including a heating component 24 and a contact assembly 26. Both the heating component 24 and the contact assembly 26 are attached to one another and are also both attached to a flexible diaphragm member 28 serving to separate the latter two components. More specifically, the diaphragm 28 (FIG. 3) is secured about its outer periphery to the housing means 10 along the common peripheral junction 16. Attachment may occur by a plurality of connecting holes 23 having conventional connectors placed therethrough. The existence of the diaphragm 28 serves to totally segregate the interior of the water chamber 12 from the interior of the contact casing 14 and also provides a watertight seal preventing water from escaping the interior of the water chamber 12 other than through the water outlet generally indicated as 30 (FIG. 4), as will be explained in greater detail hereinafter.

Further structural details of the heating component comprises an electrically insulative base 31 extending from one side of the flexible diaphragm 28 into the interior of the water chamber 12 (See FIG. 4). At least one and preferably two resistance coils 33 and 34 are mounted on the outer exposed surface 35 of the base 31 into direct contact with water passing into and throughout the interior of water chamber 12.

With reference to FIG. 3, opposite ends of each coil 33 and 34 are connected on the interior of the base 31 to respective connectors 37, 38 and 39 of the plurality of contact elements which define the contact assembly 26 to be described in greater detail hereinafter. More particularly, a common connector 37 serves as a common point of connection of ends 40 and 41 of both coils 33 and 34. The opposite end of coil 33 designated 43 passes through aperture 42 in the wall of base 31 and is connected to connector 39. The opposite end of coil 34 designated 44 is connected to the connector 38 as it passes through aperture 45. It should be noted that coil 33 is of a designated somewhat shorter length and extends from aperture, 36 to aperture 42. On the other hand, coil 34 is of a significantly longer longitudinal dimension and extends one complete revolution about the base 31 and passes through aperture 36 totally around the entire base 31 and past aperture 36 back to aperture 45.

In that coil 34 is significantly longer than coil 33, it can readily be seen that energizing of coil 34 causes significantly more heat to be transferred to the surrounding water within water chamber 12. If coil 33 is energized, heat transfer will still occur but somewhat less heat will be transferred resulting in the issuance from water chamber 12 of somewhat warm rather than hot water.

Referring to FIG. 2 and FIG. 3, each of the connectors 37, 38 and 39 are connecting points for contact elements 47, 48 and 49, respectively mounted on the upper surface of base 31. With reference to FIG. 5 each of the contact elements 47, 48 and 49 are specifically oriented for mating engagement with terminal contacts 50, 51 and 52 extending downwardly from base 53 of the contact casing 14.

This alignment is insured through the existence of a downwardly depending tongue element 54 positioned for mating engagement within a socket formed on the interior of structure 56 as the contact casing is mounted about its periphery to water chamber 12 to form a major portion of the housing means 10. With reference to FIG. 5, insulative material disk or plate 80 is positioned within the contact casing 14 and the switch housing or casing 15. Further, the switch means as well as the power terminals 59 and 60 are supported on the disk 80. Accordingly, terminal contacts 50, 51 and 52 depend downwardly from the disk 80 as clearly shown in FIG. 5. The tongue element 54 may be integrally or otherwise attached to the under portion of the disk 80 and depend downwardly therefrom so as to be disposed for mating engagement within the socket formed on the interior structure 56 (FIG. 2). A key element 55 is formed on the tongue element 54 to engage a groove structure 57 formed in the centrally located socket. This causes proper alignment and mating contact thereby establishing engagement between the contact elements 47, 48 and 49 of the terminal contacts 50, 51 and 52, respectively.

With reference to FIGS. 1, 5 and 6, a switch casing 15 is mounted on one end of the contact casing 14 and serves to house or encase the switch means generally indicated as 157. FIG. 6 shows the details of the switch means 157 with the casing removed and FIG. 7 shows details of the circuitry of the switch means. The switch means includes power terminals 59 and 60 interconnected to a conventional electrical power supply by electrical conductors 61. In addition, the switch means include terminals 62 and 64 connected to contact terminals 52 and 51, respectively, and contact terminal 50 is in turn attached to the power terminal 59 to provide a completed circuit through activation of lever means 66. Terminal slides 67, 68A and 68B are provided such that the lever means 66 which is conductive may be disposed in interconnecting relation and electrical conducting connection between the power supply terminal 60 and either one of the contact terminals 62 and 64. Positioning of lever means 66 occurs by gripping handle portion 65 mounted on the free end of the lever means and being formed from electrically insulative material. The various positions of the lever means 66 into its circuit completing position relative to the respective terminals 62 and 64 is shown in broken lines. With reference to FIG. 6, slide 67 is formed of electrically conductive material and is connected directly to power terminal 60 thereby having current flow therethrough when electrical current flows through conductor 61 and power terminal 60. For example, in the position represented by 66', the lever means pivots about a central pivotal axis colinear to the central axis of 69 and has its distal end in electrical connecting engagement with slide 67 and an opposite portion into electrical connection with slide 68A. Accordingly, the circuit is completed between the power supply and resistance coil 33. This serves to energize the coil causing it to give off heat wherein such heat is transferred to the water within water chamber 12. As the water circulates within the water chamber 12, it passes therefrom through outlet 30 into sprayhead 70. A plurality of dispersion apertures 71 from the sprayhead defines a spray pattern as the water 72 is used therefrom. It can readily be seen that the sprayhead 70 may be removably connected to the exterior water chamber in order to provide a different pattern of water flow therefrom.

On the contrary, when the lever means 66 is in the position represented by 66'', the lever means electrically engages slide 68B and the longer of the two coils 34 is activated causing the production of a greater amount of heat thereby allowing much hotter water to exit from the sprayhead 70 in a manner described above.

It should be noted that an important feature of the present invention is flexibility of the diaphragm 28 which causes its biasing of the contact assembly 26 and the contact elements 47, 48, and 49 thereon into engagement with the various terminal contacts 50, 51 and 52 upon flexure of the diaphragm as water flows into the chamber 12. More specifically, when water at least partially fills the water chamber 12 through inlet 18 pressure is exerted on the undersurface of diaphragm 28 by the water within the water chamber 12. This causes an upward movement of the 28'. This in turn causes the upward movement of the contact elements 47, 48 and 49 until they come into contacting engagement with the terminal contacts 50, 51 and 52 respectively. The diaphragm 28 will be maintained in this upward, biased position as long as water substantially fills the interior of the water chamber 12. Of course, engagement between the contact elements 47, 48 and 49 will be maintained with the terminal contacts 50, 51 and 52, respectively, as long as the diaphragm 28 is forced in its upwardly biased position. Accordingly, when the lever means 66 is properly positioned to complete the circuit between one of the coils 33 and 34, the respective coil is energized causing either warm or hot water to issue from the sprayhead in the intended pattern as described above.

It will thus be seen that the objects set forth above among those made apparent from the preceding description, are efficiently attained and, since certain changes may be made in the above construction without departing from the scope of the invention, it is intended that all matters contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described,

What is claimed is:

1. An auxiliary heater structure of the type primarily designed for heating water issuing from a water supply pipe, said heater structure comprising housing means including a water inlet means manually attachable to a water supply in receiving relation thereto, said housing means further including a water chamber including a water outlet means, said water chamber disposed to receive water therein from said water inlet means, a contact casing disposed on said housing means adjacent to said water chamber and including a plurality of contact terminals secured on the interior thereof; switch means attached to said contact casing and having power terminal means adapted to be connected to an electrical power supply source, said switch means including a plurality of switch terminals and a lever means movable into and out of current conducting relation between said switch terminals and said power terminal means, a heating assembly comprising a first resistance coil and a second resistance coil, each differing in heat output and disposed within said water chamber in heat transferring relation to water therein; diaphragm means secured to said housing means and disposed between said water chamber and said contact casing in segregating, water sealing relation therebetween, a contact assembly mounted on said diaphragm and disposed within said contact casing in engaging relation with said terminal contacts; said diaphragm means formed from a flexible material and positioned in a biased orientation within said contact casing when said water chamber substantially filled with water upon flow of water through said heating chamber from the water inlet means to the water outlet means, said contact assembly including a plurality of contact elements positioned in engagement with said plurality of contact terminals only when said diaphragm is in said biased orientation; each of said first coil and said second coil having one end connected to a first of said plurality of contact elements and the other end of said first and second coils connected to a second and a third of said plurality of contact elements, respectively, said first, said second and a third contact terminal of said plurality of contact terminals when said diaphragm is in said biased orientation, said first, said second, and said third contact terminals being connected to said power terminal means, said plurality of switch terminals including a first and a second switch terminal, said lever means completing current flow to said first coil when interconnecting said power terminal means and said first switch terminal, said level means completing current flow to said second coil when interconnecting said power terminal means and said second switch terminal, whereby current flow can be directed separately to each of said first and said second coils through positioning of said lever means.

* * * * *